US006691668B2

(12) United States Patent
Liberatore

(10) Patent No.: US 6,691,668 B2
(45) Date of Patent: Feb. 17, 2004

(54) PREVENTION OF NUISANCE ACTIVATION OF LOCOMOTIVE LOW ENGINE LUBE OIL PROTECTION MECHANISM

(75) Inventor: Aldo F. Liberatore, London (CA)

(73) Assignee: ZTR Control Systems, Minneapolis, MN (US)

( * ) Notice: Subject to any disclaimer, the term of this patent is extended or adjusted under 35 U.S.C. 154(b) by 0 days.

(21) Appl. No.: 10/154,738

(22) Filed: May 23, 2002

(65) Prior Publication Data

US 2003/0217727 A1 Nov. 27, 2003

(51) Int. Cl.[7] ..... F02B 77/00
(52) U.S. Cl. ..... 123/198 D; 123/196 R
(58) Field of Search ..... 123/198 D, 196 R, 123/41.15, 196 S, 198 DC, 198 DB

(56) References Cited

U.S. PATENT DOCUMENTS 4,413,595 A * 11/1983 Potts, Jr. ..... 123/142.5 R
4,711,204 A * 12/1987 Rusconi ..... 123/142.5 R
5,265,567 A 11/1993 Nudds et al. ..... 123/198 D

* cited by examiner

*Primary Examiner*—John Kwon
*Assistant Examiner*—Katrina B. Harris
(74) *Attorney, Agent, or Firm*—Vidas, Arrett & Steinkraus, P.A.

(57) ABSTRACT

Method and system of overriding a locomotive engine governor oil pressure sensor protective device, which involves closing a normally open solenoid valve which is placed between a locomotive engine and a governor oil pressure sensor, the solenoid valve being operably connected to an automatic shutdown and restart system, the closing of the valve maintaining the existing engine oil pressure on the governor oil pressure sensor.

6 Claims, 2 Drawing Sheets

PREVENTION OF NUISANCE ACTIVATION OF LOCOMOTIVE LOW ENGINE LUBE OIL PROTECTION MECHANISM

CROSS-REFERENCE TO RELATED APPLICATIONS

Not applicable.

STATEMENT REGARDING FEDERALLY SPONSORED RESEARCH

Not applicable

TECHNICAL FIELD

The present invention relates to a system and method for automatic shutdown and restart of a locomotive engine with a low engine lube oil protection mechanism.

BACKGROUND OF THE INVENTION

Applicant's SmartStart® system is a locomotive automatic shutdown and restart system. It offers railroads significant fuel savings by reducing unnecessary idling time. It is a mature device that has been available for over 10 years. Applicant's SmartStart® system was patented in U.S. Pat. No. 5,265,567, the entire contents of which are hereby incorporated by reference.

The SmartStart® system, as well as any other locomotive automatic shutdown and restart system, must be applied such that it does not interfere with the locomotive's original protection devices. Yet, on many locomotives, these devices may prevent a successful automated restart.

One such engine protection mechanism is the engine low oil button. This mechanism is built into the locomotive's engine speed governor and is found on the majority of North American and export locomotives. This device senses the engine oil pressure, and if it is below a safe limit, will shut the engine down.

FIG. 1 is a typical prior art engine lube oil configuration on an EMD locomotive with a mechanical governor. Oil is sourced from the engine's sump, conditioned to be cleaned and cooled, then forced through the engines pistons, bearings and other moving components.

There are typically 12 to 16 power packs (cylinder assemblies) in an engine. Thus, there is a delay on start-up to achieve the required pressure on the last cylinder and bearing assembly. At this point, a line is piped to the engine's governor.

Within the governor, an isolated system is used to generate internal governor pressure. The governor's internal oil pressure is placed on one side of a diaphragm and matched against engine oil pressure on the other side. If this is balanced, the governor functions normally. A design feature of the governor is to allow the engine oil pressure approximately 60 seconds to build up before enabling the low oil pressure shutdown feature. If the engine oil pressure is low after this dwell period, which is applicable only after engine start-up, the governor will shut off the fuel supply to the engine. This will result in the engine shutting down. Once the governor's low oil mechanism trips, it needs to be physically reset. This is done by either manual intervention, or by an exterior device that is controlled by the automated shutdown restart system. While effective, the latter is expensive, awkward to install, and impedes regular maintenance of the governor.

There are several reasons that might create a low oil condition causing a trip in the governor's protection mechanism. The most obvious is a genuine low oil pressure condition, caused by a blockage in the lube oil's path, a problem with the pump, a leak in the engine's sump or any number of other legitimate reasons.

Unfortunately, a small group of locomotives are susceptible to unwarranted trips of the low oil button by taking more than the allotted time to initially build up pressure when starting up. Another small group will experience unwarranted trips as a result of shutting down on the engine. This is caused by a race condition where the engine oil pressure drops extremely rapidly in relationship to the governor's internal oil pressure. Other causes of nuisance low oil button trips include shockwaves in the lube oil supply lines created by jerky motions in the engine's crankshaft during the startup or shutdown process. Regardless of the cause, the result is predictable and will prevent the locomotive from being automatically restarted until the governor low oil button is physically reset.

As mentioned earlier, the SmartStart® system does offer a cumbersome and expensive product that will effectively reset the low oil button during shutdown and start up. Some railroads have utilized this device successfully.

Other railroads have attempted to resolve this issue by replacing the governor and other engine components. This can be very expensive and time consuming. In some cases, extensive attempts have not resolved the issue.

What is needed is a relatively inexpensive solution that is easy to apply, does not interfere with the governor's normal maintenance, and reliably prevents the locomotive from shutting down unnecessarily during automatic startup or shutdown.

BRIEF SUMMARY OF THE INVENTION

Applicants have solved the problems discussed above by adding a solenoid valve between the engine and the governor oil pressure sensor. Upon automatic engine shutdown, the solenoid valve is closed, thereby maintaining the existing engine oil pressure on the governor oil pressure sensor. The valve is kept closed until a short period, such as 1 minute, after the engine is automatically restarted.

BRIEF DESCRIPTION OF THE SEVERAL VIEWS OF THE DRAWING

A detailed description of the invention is hereafter described with specific reference being made to the drawings in which.

DETAILED DESCRIPTION OF THE INVENTION

Figure 1:
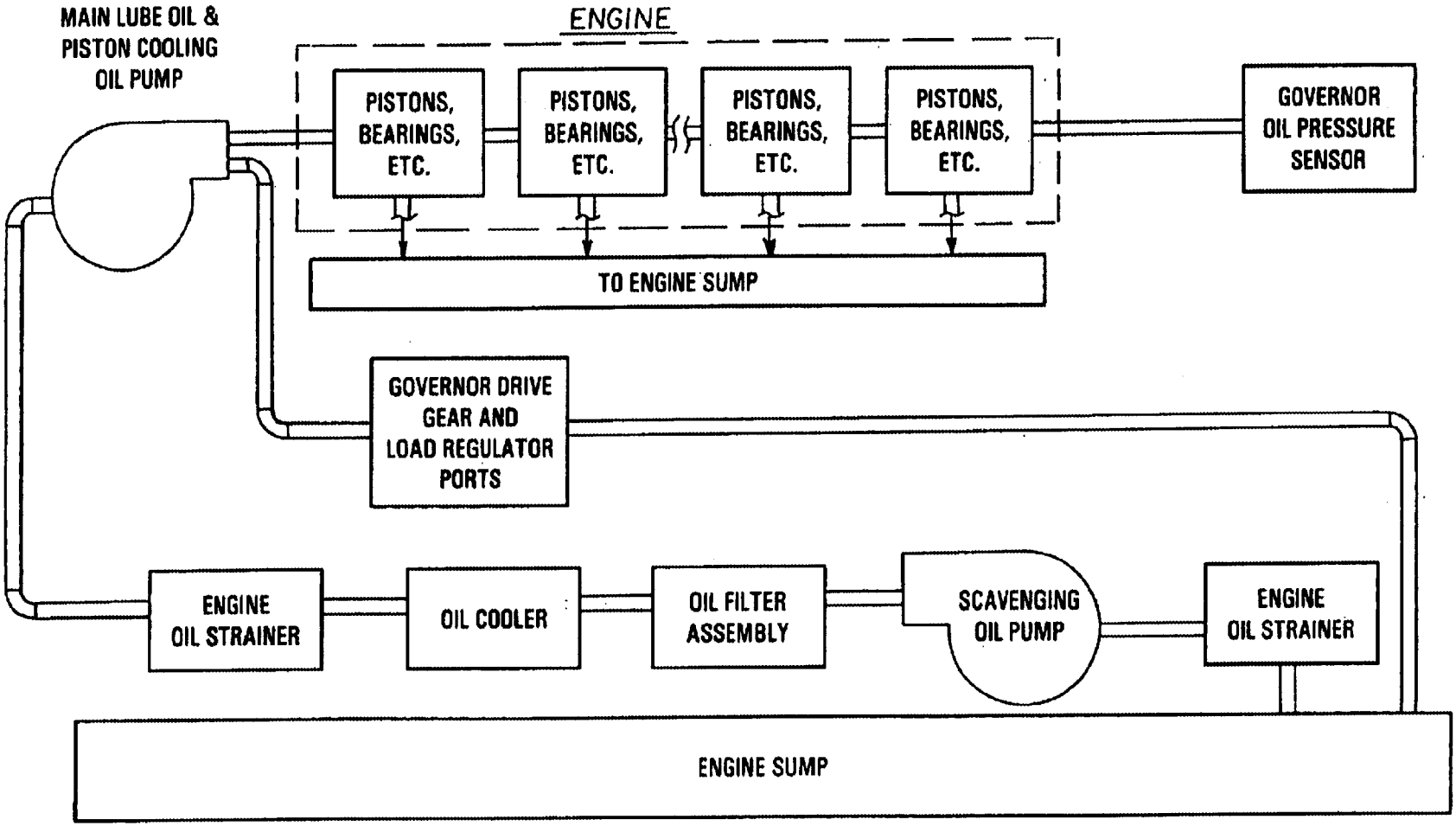
Fig. 1 PRIOR ART
FIG. 1 is a block diagram of a prior art locomotive engine.
Figure 2:
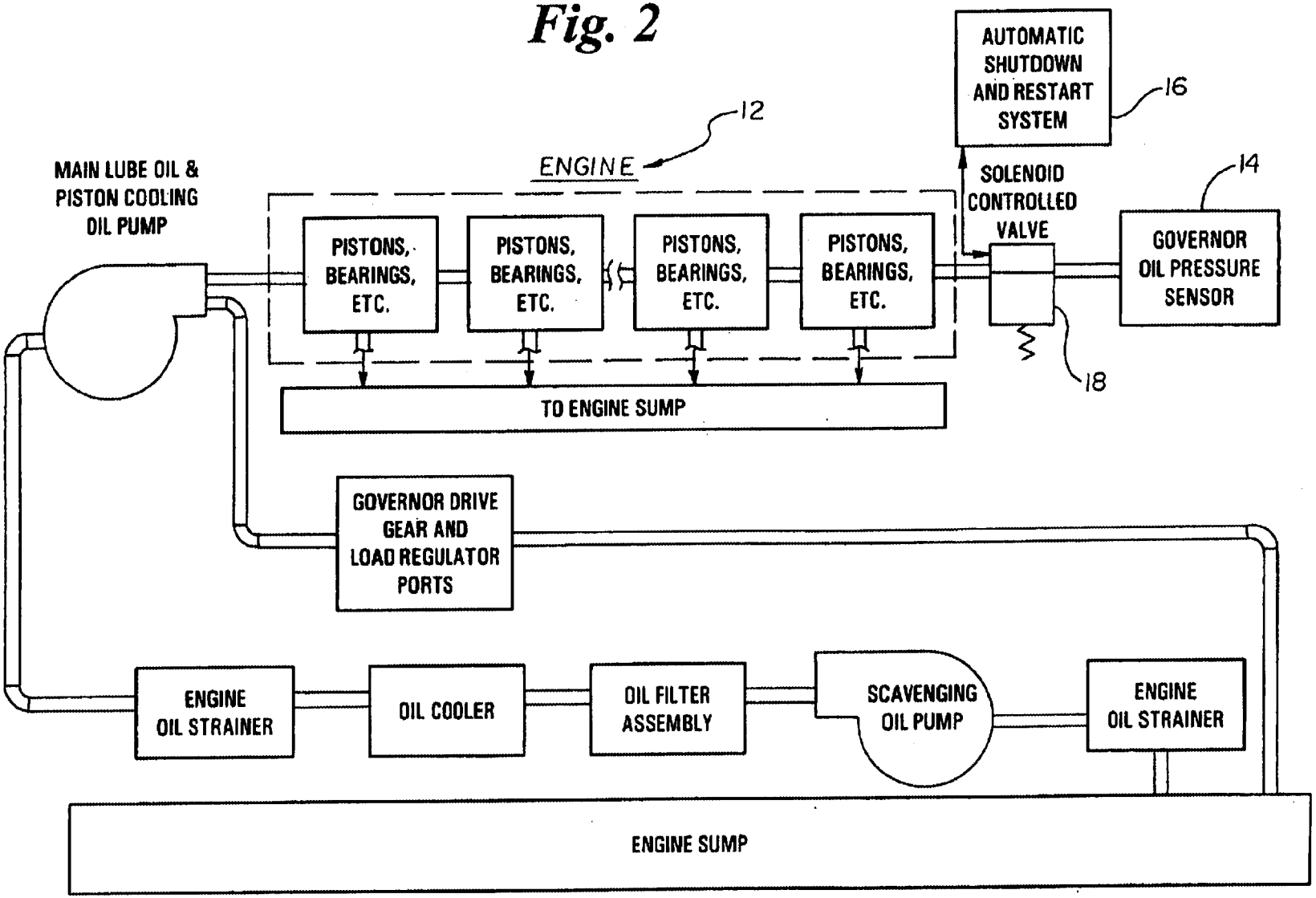
FIG. 2 is a block diagram of the improved inventive automatic engine shutdown and restart system.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated. FIG. 2 is a block diagram of the improved automatic shutdown and restart system in which the locomotive engine is shown generally at 12, the governor oil pressure sensor is shown at 14 and the automatic shutdown and restart system is shown at 16. An electrically controlled solenoid valve is shown at 18, between the engine 12 and the governor 14. Valve 18 is normally open, but is closed by the automatic shutdown and restart system 16 prior to initiating automatic engine shutdown. Shutting valve 18 does two things: first, it traps the engine lube oil pressure that existed just prior to shutting the engine down, and second, it prevents any shock waves that might be generated from the action of shutting down the engine from reaching the governor's diaphragm. The solenoid valve 18 is kept energized or closed until after the engine is automatically restarted. Once the engine has been successfully restarted, the solenoid valve is de-energized or opened after 60 seconds. This corresponds with the governor's internal dwell time before enabling the low oil protection. After the solenoid is de-energized, the valve is open and normal low oil protection is established.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A locomotive automatic shutdown and restart system of the type for automatically shutting down and restarting a locomotive engine which has a governor oil pressure sensor for automatically shutting down the engine upon sensing a low engine oil pressure condition, the improvement comprising:

a normally open solenoid valve which is operably connected to the automatic shutdown and restart system, the solenoid valve being placed between the engine and the governor oil pressure sensor, the normally open solenoid valve being closed by the automatic shutdown and restart system just prior to automatic engine shutdown to maintain the existing engine oil pressure on the governor oil pressure sensor.

2. A locomotive automatic shutdown and restart system of the type for automatically shutting down and restarting a locomotive engine which has a governor oil pressure sensor for automatically shutting down the engine upon sensing a low engine oil pressure condition, the improvement comprising:

a normally open solenoid valve which is operably connected to the automatic shutdown and restart system, the solenoid valve being placed between the engine and the governor oil pressure sensor, the normally open solenoid valve being closed by the automatic shutdown and restart system just prior to automatic engine shutdown to maintain the existing engine oil pressure on the governor oil pressure sensor;

wherein the closed solenoid valve is opened by the automatic shutdown and restart system a predetermined period of time after automatic engine restart is initiated.

3. The locomotive automatic shutdown and restart system of claim 2 wherein the predetermined period of time is 1 minute.

4. A method of overriding a locomotive engine governor oil pressure sensor protective device comprising the steps of:

closing a normally open solenoid valve which is placed between a locomotive engine and a governor oil pressure sensor, the solenoid valve being operably connected to an automatic shutdown and restart system, the closing of the valve maintaining the existing engine oil pressure on the governor oil pressure sensor.

5. A method of overding a locomotive engine governor oil pressure sensor protective device comprising the steps of:

closing a normally open solenoid valve which is placed between a locomotive engine and a governor oil pressure sensor, the solenoid valve being operably connected to an automatic shutdown and restart system, the closing of the valve maintaining the existing engine oil pressure on the governor oil pressure sensor;

opening the closed solenoid valve a predetermined period of time after automatic engine restart is initiated.

6. The method of claim 5 wherein the predetermined period of time is 1 minute.

* * * * *